US005581145A

United States Patent [19]

Kato et al.

[11] Patent Number: 5,581,145

[45] Date of Patent: Dec. 3, 1996

[54] SPARK PLUG

[75] Inventors: Akio Kato, Nishio; Keiji Kanao, Okazaki, both of Japan

[73] Assignee: Nippondenso Co., Ltd., Kariya, Japan

[21] Appl. No.: 335,359

[22] Filed: Nov. 3, 1994

[30] Foreign Application Priority Data

Nov. 5, 1993 [JP] Japan ..... 5-276853

[51] Int. Cl.[6] ..... H01T 13/20

[52] U.S. Cl. ..... 313/141; 313/123; 313/140

[58] Field of Search ..... 313/123, 140, 313/141

[56] References Cited

U.S. PATENT DOCUMENTS

| | | | |
|---|---|---|---|
| 3,577,170 | 5/1971 | Nylen | 313/123 |
| 3,719,851 | 3/1973 | Burley | 313/123 |
| 4,914,344 | 4/1990 | Watanabe et al. | 313/141 |
| 4,983,877 | 1/1991 | Kashiwara et al. | 313/140 |
| 5,107,168 | 4/1992 | Friedrich et al. | 313/140 |
| 5,189,333 | 2/1993 | Kagawa et al. | 313/140 |
| 5,456,241 | 10/1995 | Ward | 123/598 |

FOREIGN PATENT DOCUMENTS

| | | | |
|---|---|---|---|
| 51-91435 | 8/1976 | Japan | H01T 13/46 |
| 52-15739 | 5/1977 | Japan | H01T 13/32 |
| 52-39142 | 10/1977 | Japan | H01T 13/46 |
| 5326107 | 12/1993 | Japan | H01T 13/32 |

*Primary Examiner*—Alvin E. Oberley
*Assistant Examiner*—Lawrence O. Richardson
*Attorney, Agent, or Firm*—Cushman, Darby & Cushman

[57] ABSTRACT

A spark plug having a low discharge voltage and good ignition performance. The object is achieved by means of a structure which satisfies the conditions:

$g3 \geqq 1.2-g1$;

$g2 \leqq g3-(d2-d1)/2$;

$g1 \leqq g2 \leqq 1.6$; and $0 \leqq h \leqq 2$ when the first spark gap size is made to be g1 mm, the second spark gap size is made to be g2 mm, the shortest distance between the center electrode tip surface peripheral portion and the second ground electrode tip surface outer end portion is g3 mm, the center electrode tip portion diameter is d1 mm, the center electrode body diameter is d2 mm, and height from an edge of said tip surface of said second ground electrode to said tip surface is h min.

4 Claims, 15 Drawing Sheets

SPARK PLUG

This application is based upon and claims priority from Japanese Patent Application 5-276853 filed Nov. 5, 1993, the contents of which are incorporated herein by reference.

BACKGROUND OF THE INVENTION

1. Field of the Invention

The present invention relates to a spark plug employed as an ignition device in an internal combustion engine.

2. Related Art

The reduction of fuel consumption by internal combustion engines used in automobiles and other motor vehicles has been a high priority globally due to environmental concerns as well as global-resource concerns. To address these concerns, measures for gasoline engines in particular have been accomplished concerning the implementation of lean burning of fuel and the like through high compression and a lean air-fuel mixture. Because of these measures, however, the discharge voltage of the spark plug has tended to become extremely high.

Furthermore, a DLI ("distributorless ignition") system, which, as the name implies, does not use a distributor, a unit ignition system, and a diode distribution ignition system have been suggested as possible ignition systems. In the DLI system and the diode distribution system, simultaneous discharge to two cylinders occurs with one ignition coil, and so one spark plug functions so that the center electrode side thereof has a high-potential discharge ("positive polarity"), and the other spark plug is such that the center electrode side has a low-potential discharge ("negative polarity"). An ignition system according to conventional methods that use a distributor is a negative polarity system. Here, the discharge voltage required for the positive- polarity becomes extremely high with respect to the discharge voltage required for the negative polarity.

Accordingly, reduction of the discharge voltage has been addressed with extreme urgency, and Japanese Patent Application Laid-open No. 51-91435 and Japanese Examined Patent Publication No. 52-15739 have proposed techniques for reducing such discharge voltage. Fundamentally, each of these documents discloses a spark plug provided with two spark areas, consisting of a first spark gap and a second spark gap formed of a center electrode, a ground electrode bent so as to oppose the tip surface of the center electrode, and another bent ground electrode having a tip surface which opposes a side surface of the center electrode. Efforts are made to reduce the discharge voltage by means of a combined discharge which includes discharge at the first spark gap and discharge at the second.

However, because flame propagation is better the closer a spark area is to the center of the combustion chamber, i.e., the more the spark area protrudes from the metal housing end surface, the higher the torque generated by the engine, but because two spark areas exist in known devices, fluctuations in torque are generated, thus causing fluctuations in engine speed. In short, assiduous implementation has not been carried out due to worsening ignition performance.

SUMMARY OF THE INVENTION

In light of the circumstances described above, it is an object of the present invention to provide a spark plug having low discharge voltage without mixing the discharge of a first spark gap and discharge of a second spark gap, and further having good ignition performance with no torque fluctuations being produced.

Accordingly, the present invention solves the problems noted above by means of a spark plug comprising an insulator having a through-hole, a center electrode having a tip portion having a first diameter, a tip surface at the end of said tip portion and a center electrode body having a second diameter larger than said first diameter and maintained in said through-hole, a voltage propagation means provided in said through-hole, a housing maintaining said insulator, at least first and second bent ground electrodes attached to a tip surface of said housing. And said first ground electrode opposes said tip surface of said center electrode to form a first gap between said tip surface and said first ground electrode and said second ground electrode opposes a lateral peripheral surface of said center electrode to form a second gap between said center electrode body and said second ground electrode. Also, the present invention satisfies the following equations (1)–(4):

$$g3 \geqq 1.2\text{-}g1 \ldots \quad (1)$$

$$g2 \leqq g3\text{-}(d2\text{-}d1)/2 \ldots \quad (2)$$

$$g1 \leqq g2 \leqq 1.6 \ldots \quad (3)$$

$$0 \leqq h \leqq 2 \ldots \quad (4)$$

where the first spark gap size is represented by g1 (mm), the second spark gap size is represented by g2 (mm), the shortest distance between the center electrode tip surface peripheral portion and the second ground electrode tip surface outer end portion is represented by g3 (mm), the center electrode tip portion diameter is represented by d1 (mm), the center electrode body diameter is represented by d2 (mm), and the center electrode protrusion length coaxial with the electrode and toward the second ground electrode outer side is represented by h (mm).

Alternatively, the present invention addresses the above problem by means of a spark plug comprising an insulator having a through-hole, a center electrode maintained in the through-hole, a voltage propagation means provided in the through-hole, a housing maintaining the insulator, a bent ground electrode attached to an tip surface of the housing, and a spark gap formed by means of the center electrode and the ground electrode. The ground electrode opposes a tip surface of the center electrode, thus forming a first ground electrode and opposes a lateral peripheral surface of the center electrode so as to form a second ground electrode. A first spark gap is formed by means of the center electrode and the first ground electrode, and a second spark gap is formed by means of the center electrode and the second ground electrode. The diameter of the center electrode's tip portion is smaller than a diameter of the center electrode's body. Also, a tip surface of the ground electrode and/or the center electrode includes an electrode composed of a precious metal or a precious metal alloy. Further, the spark plug satisfies conditions (1)–(4) set forth above.

According to the present invention, the spark area can be fixed at the first spark gap by means of making:

$g3 \geqq 1.2\text{-}g1$;

$g2 \leqq g3\text{-}(d2\text{-}d1)/2$; and $g1 \leqq g2$.

Moreover, because:

$g1 \leqq g2 \leqq 1.6$ and $0 \leqq h \leqq 2$ the discharge voltage can be reduced. Thus, the present invention achieves a low discharge voltage and it has fixed the spark area at the first spark gap. So, it is possible to provide a spark plug having an excellent ignition performance capable of reducing the idling unstable rate.

BRIEF DESCRIPTION OF THE DRAWINGS

Other objects, features and characteristics of the present invention will become apparent to those skill in the art upon a detailed study of the following detailed description, and the appended claims and drawings. In the drawings:

DETAILED DESCRIPTION OF THE PRESENTLY PREFERRED EXEMPLARY EMBODIMENTS

Diligent and concerted study by the present inventors has revealed that in addition to deterioration of the ignition performance caused by sparking at two different locations of the spark area in conventional devices, the surface area of the tip surface of the center electrode exerts a considerable effect on growth of the flame nucleus generated by the spark. Accordingly, an embodiment of the present invention having low discharge voltage as well as good ignition performance will be described below with reference to the drawings.

Figure 2:
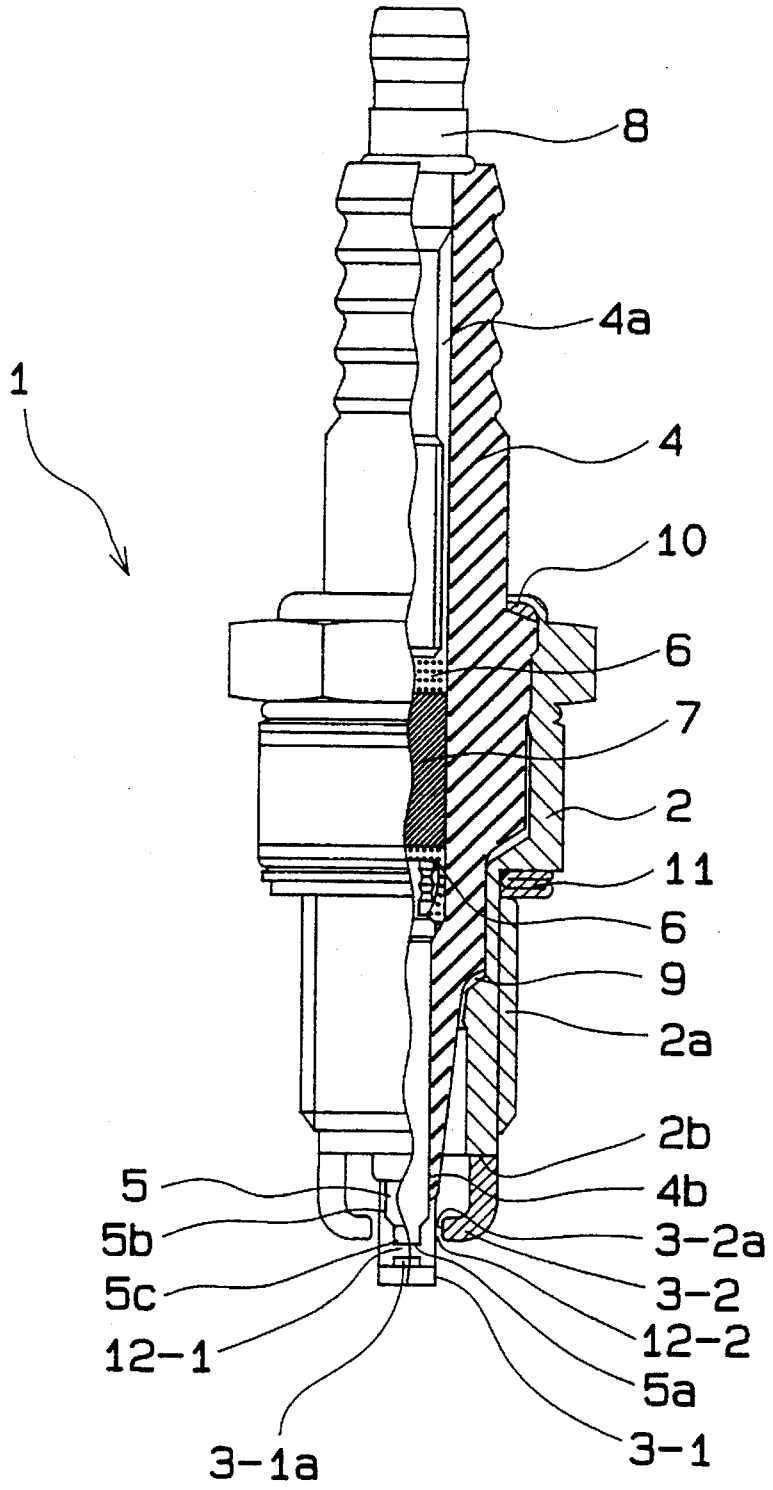
FIG. 2 is a partial sectional view of a spark plug according to a first embodiment of this invention.

FIG. 2 illustrates a partial sectional view indicating spark plug 1 according to the first embodiment of the present invention. Spark plug 1 includes center electrode 5 composed of a heat-resistant and corrosion-resistant material such as a nickel alloy at the tip of through-hole 4*a* provided in insulator 4, which is composed of alumina or the like. Further, spark plug 1 includes terminal electrode 8 composed of a metal material such as iron at the end of through-hole 4*a* opposite from electrode 5. Insulator 4 contains conductive glass 6 and a resistance body 7. Housing 2 is made of metal such as low-carbon steel and fixes insulator 4 via gasket 10 and ring 9 made of a metal such as copper. Housing 2 is provided with thread portion 2*a* and housing tip surface 2*b* is provided with first ground electrode 3-1 formed from a heat-resistant and corrosion-resistant material such as a nickel alloy. Bent tip 3-1*a* of first ground electrode 3-1 opposes tip surface 5*a* of center electrode 5, and is disposed so as to form first spark gap 12-1. Further, housing tip surface 2*b* is provided with two second ground electrodes 3-2 positioned 90° with respect to center electrode 5 of first ground electrode 3-1. Accordingly, tip surface 3-2*a* of second ground electrodes 3-2 is disposed so as to oppose lateral peripheral surface 5*b* of center electrode 5, forming second spark gap 12-2. Additionally, high voltage is applied between terminal electrode 8 and housing 2, and is propagated to first or second spark gap 12-1 or 12-2 by means of a voltage propagation means structured from terminal electrode 8, conductive glass 6, and resistance body 7.

Figure 3:
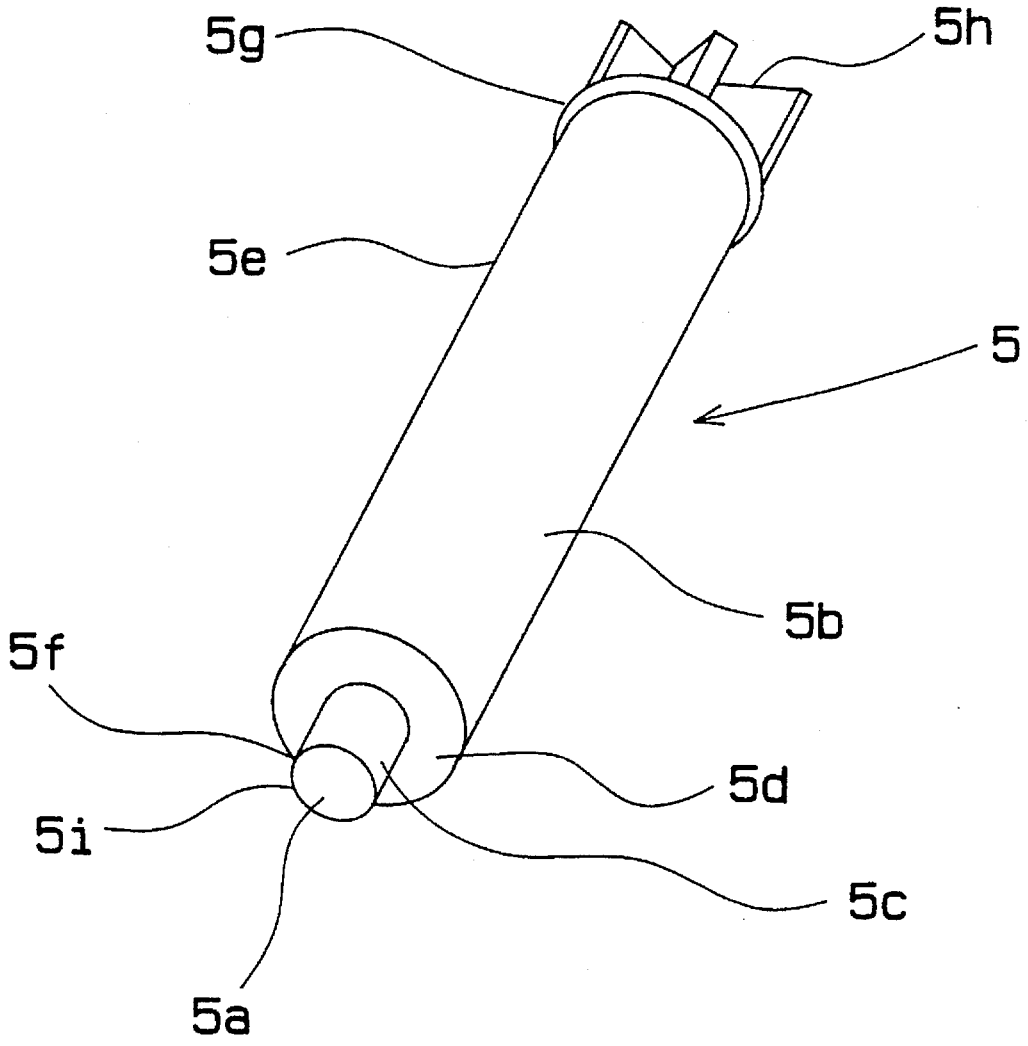
FIG. 3 is a perspective view of a center electrode which is one part of this invention.

FIG. 3 is a perspective view of center electrode 5, which is a forged part produced by means of cold forging and cut to provide tip 5*f* having a cylindrical configuration and truncated-cone portion 5*d* on a tip portion of body 5*e*. Body 5*e* of center electrode 5 is retained on a maintaining means provided in through-hole 4*a* in insulator 4. The maintaining means is not shown in FIG. 1. Collar portion 5*g* is attached to lateral peripheral surface 5*b* of body 5*e* during cold forging. Collar portion 5*g* is held at through-hole 4*a* and fixed by conductive glass 6. Additionally, reference numeral 5*c* is a lateral peripheral surface of body 5*e*.

Figure 1A:
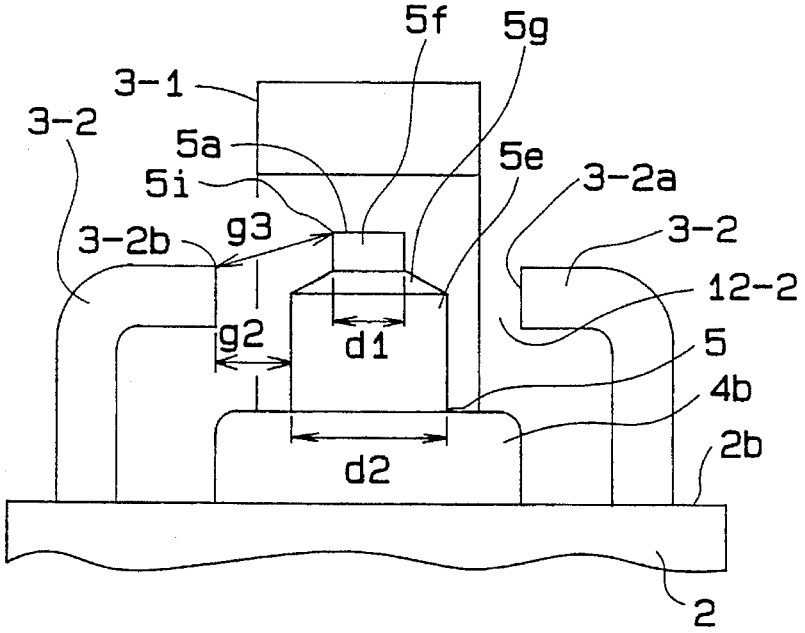
FIG. 1A is a partial enlarged front view of the essentials of a spark plug according to an embodiment of this invention.
Figure 1B:
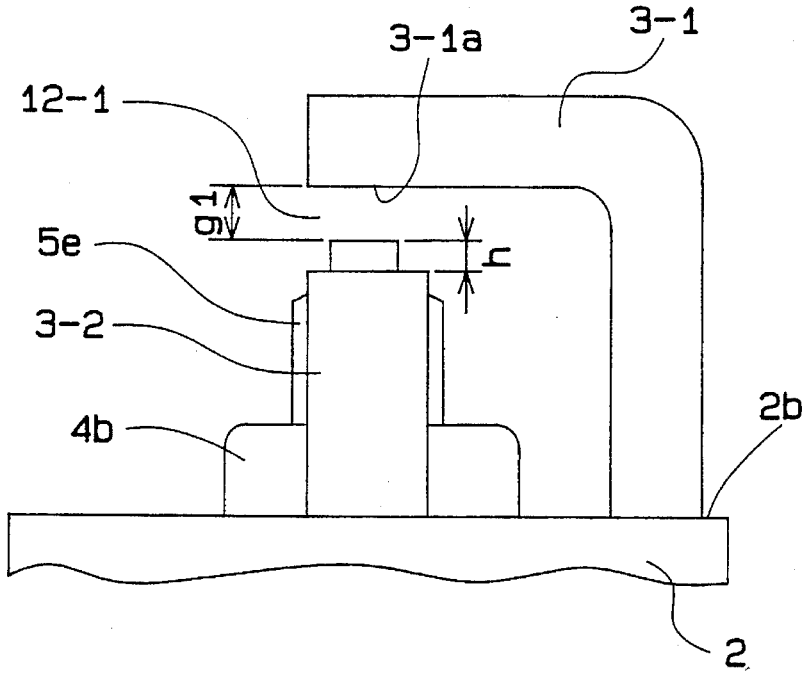
FIG. 1B is a partial enlarged side view of the essentials of a spark plug according to an embodiment of this invention.
Figure 20:
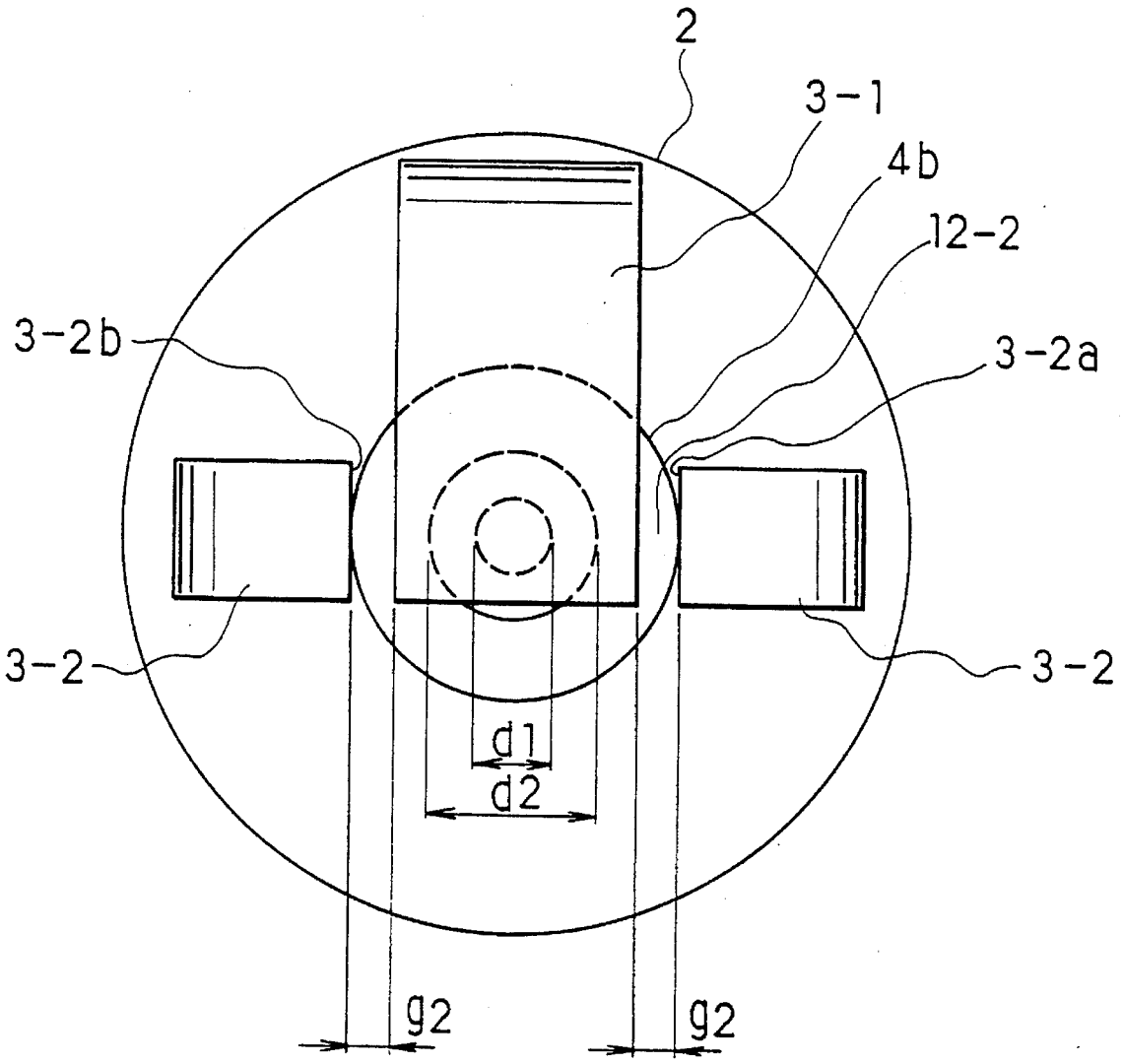
FIG. 20 is a top view of the essentials of a spark plug according to a first embodiment of FIG. 1A.

FIG. 1A is a partial enlarged front view illustrating an essential portion of the first embodiment according to the present invention, and FIG. 1B is a side view thereof. Further FIG. 20 is a top view thereof. According to these drawings, g1 represents the size (distance) of first spark gap 12-1, g2 represents the size of second spark gap 12-2, g3 represents the shortest distance between an outer end portion 3-2*b* of tip surface 3-2*a* of second ground electrode 3-2 and peripheral portion 5*i* of tip surface 5*a* of center electrode 5. Further, h is the coaxial distance with the above-mentioned center electrode 5 between the upper end portion of tip surface 3-2*a* and tip surface 5*a* of center electrode 5, d1 represents the diameter of tip 5*f*, and d2 represents the diameter of body 5*e*. First and second ground electrodes 3-1 and 3-2 have both bent shapes. As shown in FIG. 20, tip surface 3-2*a* of second ground electrode 3-2 has a flat surface and outer end portion 3-2*b* of second ground electrode 3-2 has a straight shape.

In order to improve the ignition performance, it is necessary to restrict spark generation to first spark gap 12-1. Additionally, the spark is believed to be generated from near the circumferential portion of the tip surface 5*a* of center electrode 5, where electrical field strength is normally the greatest. Because of this, the relationship of the values g1 and g2 is believed to have an extremely large influence on restricting spark generation at first spark gap 12-1, and the present inventors have spent many hours performing diligent study in this area. The results of their study will be described below.

A prototype of the above-mentioned spark plug 1 was made as a thermal value No. 20 (hereinafter termed "thermal value No. 20"), which is the thermal value nomenclature used by the assignee of the present invention, the employer of the inventors. Here, the prototype was devised using two values for g1=0.8 mm and 1.0 mm, and taking g2=0.85 mm, g3=0.8 to 1.4 mm, d2=2.5 mm, and h=0 mm. The prototype article devised using these values was evaluated in an airtight container filled with air by setting the discharge frequency at 30 Hz and applying high voltage to the center electrode to cause spark discharge. High voltage was applied at both positive polarity and negative polarity. Moreover, the spark plug was evaluated at bench conditions simulating engine conditions, and the pressure within the above-mentioned airtight container was set at 2 kg/cm$^2$, which is equivalent to a normal running condition and varied up to 6 kg/cm$^2$, which is equivalent to excessive running.

Figure 8:
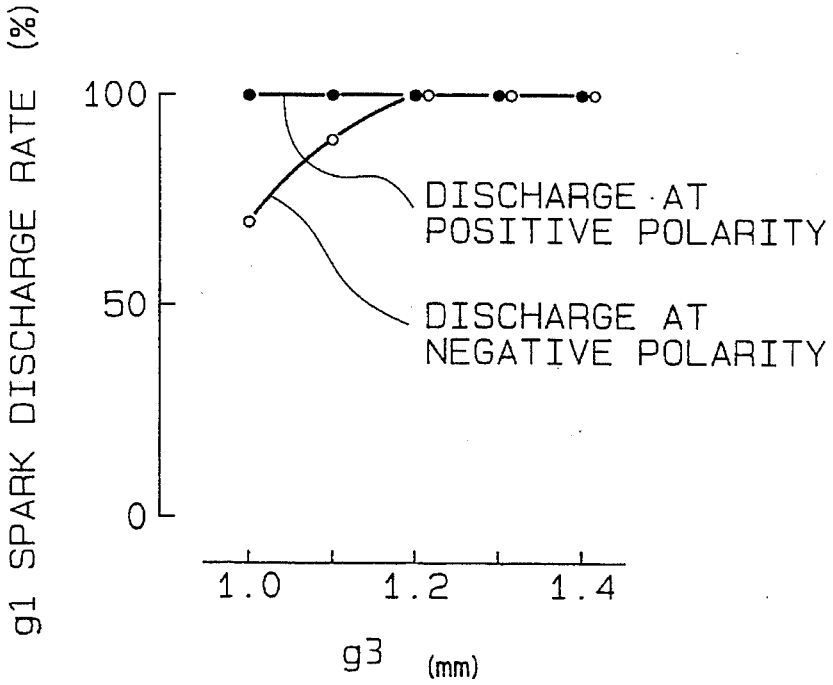
FIG. 8 is a graph indicating a spark discharge rate at a first spark gap of the first embodiment.

FIG. 8 indicates the measurement results for the spark discharge rate where g1=1.0 mm. Here, the spark discharge rate is defined as:

Spark discharge rate=(Number of Actual Spark Discharges at a Certain Spark Gap)/(Total Number of Spark Discharges) and the spark gap having the greatest spark discharge rate is termed the main gap. According to this graph, in order to take first spark gap 12-1 as the main gap and also set the spark discharge rate at 100%, g3 should satisfy the condition g3≧1.2 mm, regardless of whether discharge may be of positive polarity or of negative polarity.

Figure 9:
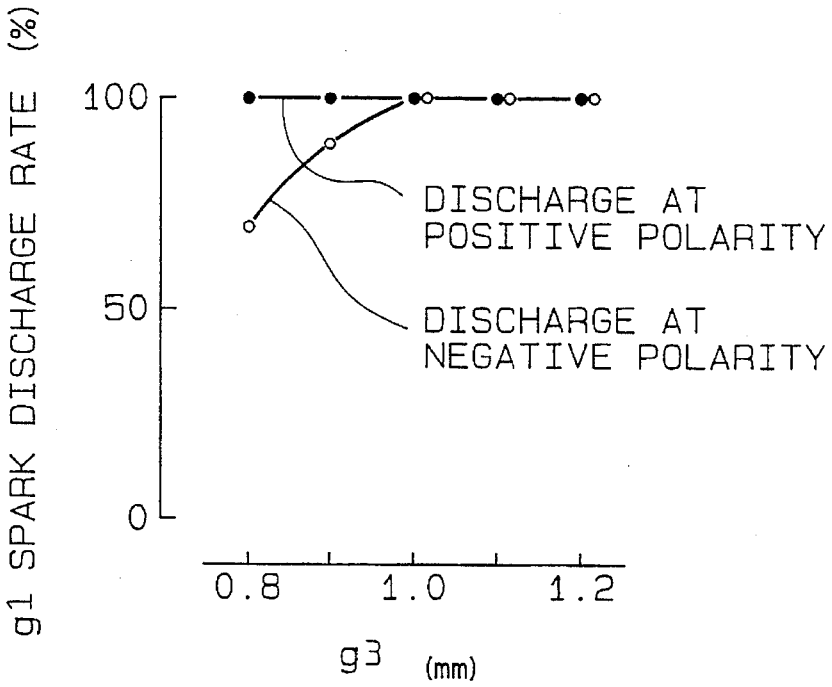
FIG. 9 is a graph indicating a spark discharge rate at a first spark gap of the first embodiment.

FIG. 9 indicates the measurement results for the spark discharge rate where g1=0.8 mm. According to this graph, in order to set the spark discharge rate of the above-mentioned first spark gap 12-1 at 100%, it is acceptable that g3≧1.0 mm, regardless of whether discharge may be of positive polarity or of negative polarity.

From the above results, if:

g3≧1.2-g1 it is possible to cause all sparks to be generated at first spark gap 12-1. To do this, moreover, because of the positional relationship of center electrode 5 and second ground electrode 3-2 it is necessary that:

g2≦g3-(d2-d1)/2.

Next, a prototype was devised using the two values of g1, g1=0.8 mm and 1.0 mm, and taking g2=0.6 to 1.2 d1=1.0 mm, d2=2.5 mm, and h=0.5 mm. With regard to g3, the prototype was devised so as to satisfy:

g3≧1.2-g1, and g2≦g3-(d2-d1)/2.

Figure 10:
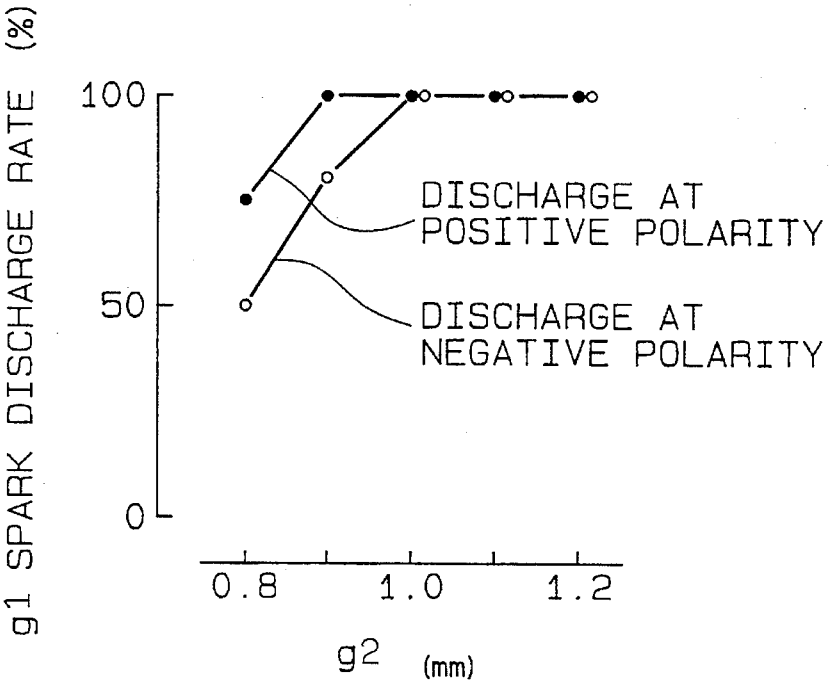
FIG. 10 is a graph indicating a spark discharge rate at a first spark gap of the first embodiment.

FIG. 10 indicates the measurement results for g2 of the spark discharge rate where g1=1.0 mm. According to this graph, in order to set the spark discharge rate of first spark gap 12-1 at 100%, it is acceptable that g2≧1.0 mm, regardless of whether discharge is of positive polarity or negative polarity.

Figure 11:
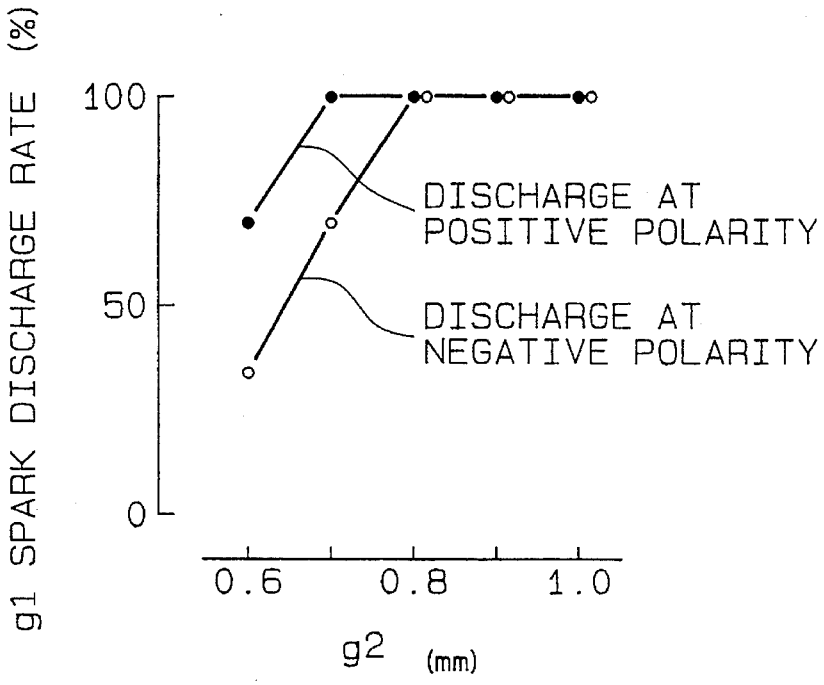
FIG. 11 is a graph indicating a spark discharge rate at a first spark gap of the first embodiment.
Figure 12:
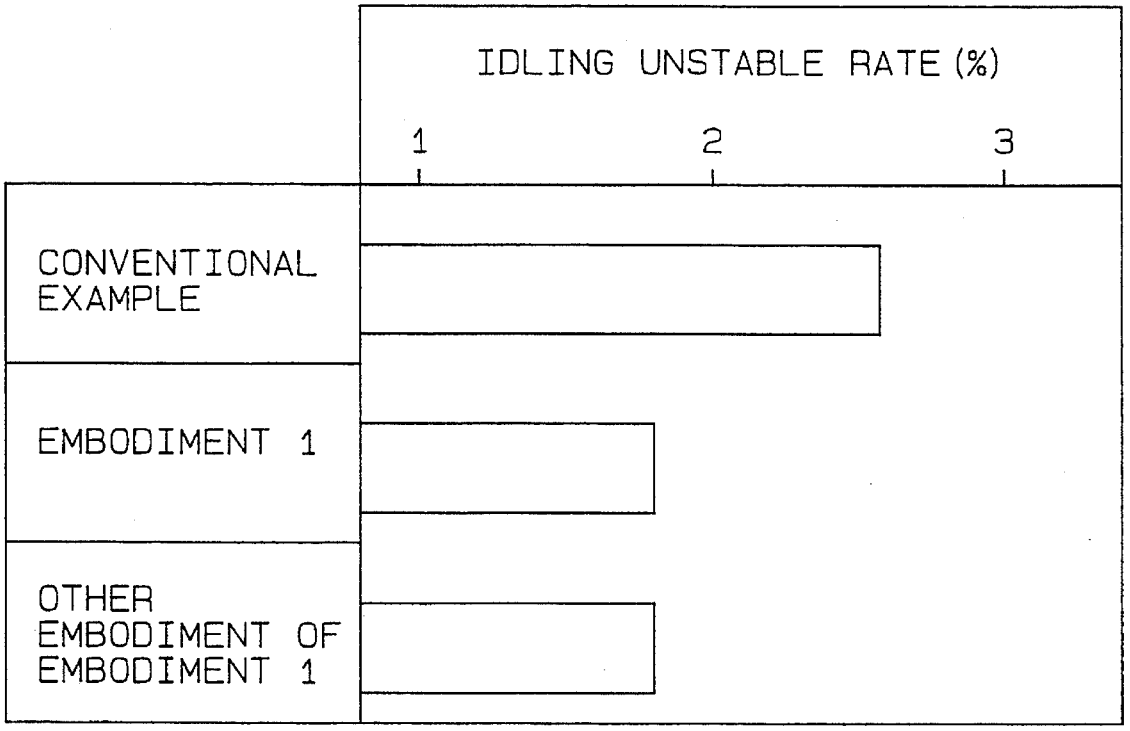
FIG. 12 is a graph indicating an idling unstable rate of a spark plug according to the first embodiment.

FIG. 11 indicates the measurement results for g2 of the spark discharge rate where g1=0.8 mm. According to this graph, in order to take first spark gap 12-1 as the main gap and also set the spark discharge rate at 100%, it is acceptable that g2≧0.8 mm, regardless of whether discharge is of positive polarity or negative polarity.

From the above results, if:

g3≧1.2-g1, and g2≦g3-(d2-d1)/2, and g1≦g2 spark generation can be restricted to first spark gap 12-1 as the main gap.

Figure 6:
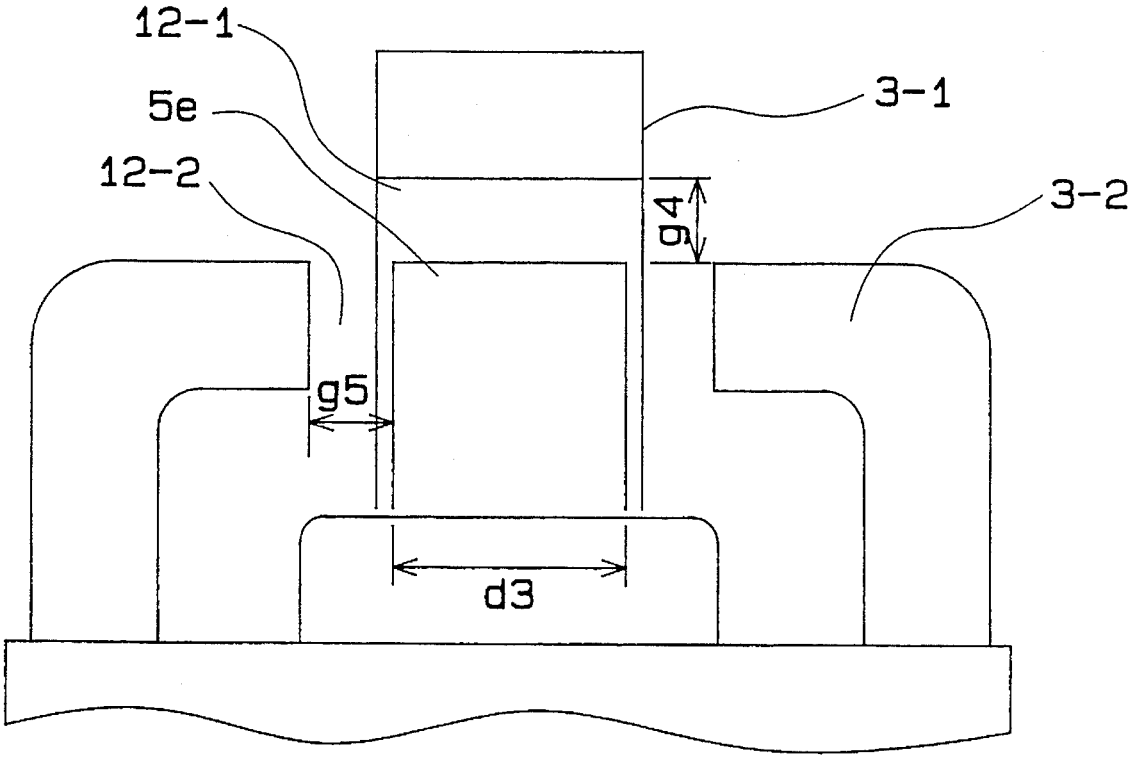
FIG. 6 PRIOR ART
FIG. 6 is a partial enlarged front view of the essentials of a spark plug according to the prior art.

Next, an article according to this invention wherein g1=1.0 mm, g2=1.0 mm, g3=1.8 mm, d1=1.0 mm, d2=2.5 mm, and h=0 mm, which satisfies the following conditions:

g3≧1.2-g1, g2≦g3-(d2-d1)/2, and g1≦g2, and a conventional spark plug were comparatively evaluated in an actual engine. FIG. 6 is a partial enlarged front view of the essential portion of a conventional article as compared to the present invention. In this figure, an article where g4=g5=1.0 mm and d3=2.5 mm is employed as a comparative example. Additionally, a water-cooled, 4-cycle, 1500 cc, 4-cylinder automotive engine was used in the evaluation, and the evaluation was conducted by means of the idling unstable rate at an idling rate of 650 rpm. The idling unstable rate referred to here is:

Idling unstable rate=(Momentary Speed Standard Deviation/Momentary Speed Mean Value)×100%, determined from all data, with measurements of momentary speed occurring at 0.2 second intervals for 3 minutes, thereby providing 900 samplings. Briefly, the idling unstable rate signifies that the greater the fluctuation in speed, the poorer the ignition performance in the evaluation of the conventional article, fluctuations in torque are generated because two spark areas exist and ignition performance is poor because this causes fluctuation in engine speed. In the spark plug according to the present invention, it has proven possible to fix the spark area. Also, because of having cylindrical portion 5*f* with a diameter smaller than the diameter of body 5*e* of center electrode 5, it is believed that the quenching effect is reduced and ignition performance is enhanced.

Figure 4:
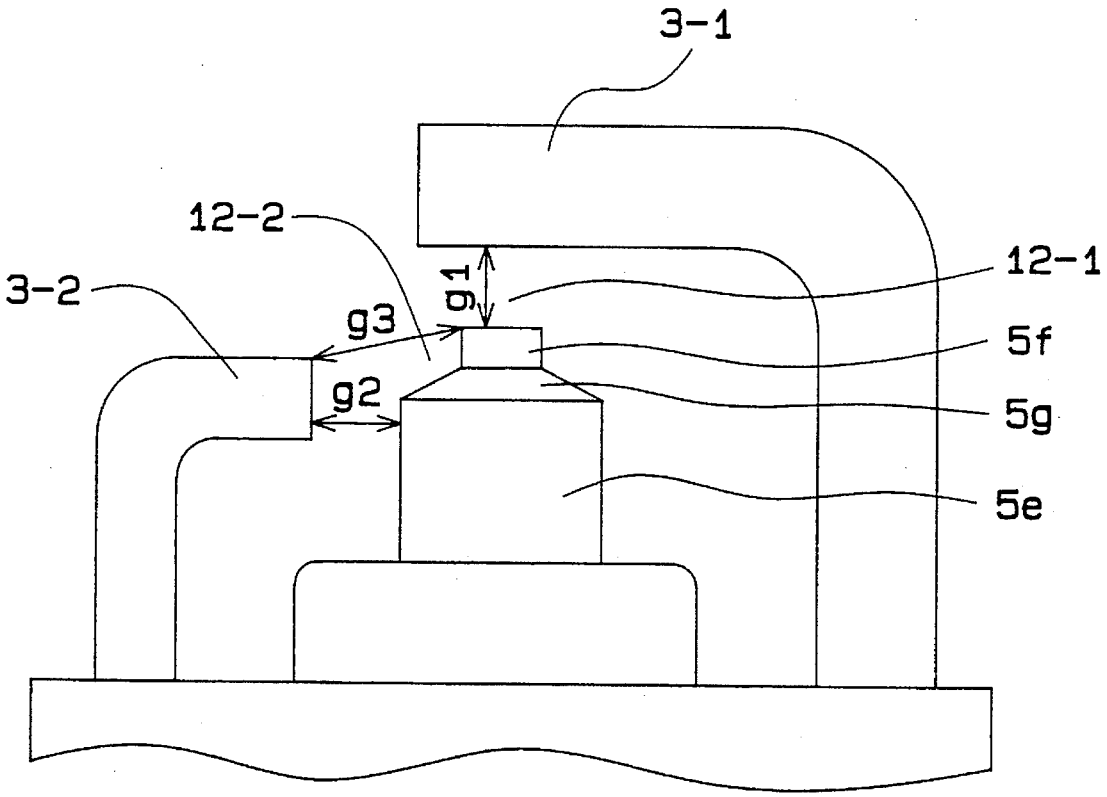
FIG. 4 is a partial enlarged side view of the essentials of a spark plug according to another embodiment of this invention.
Figure 5:
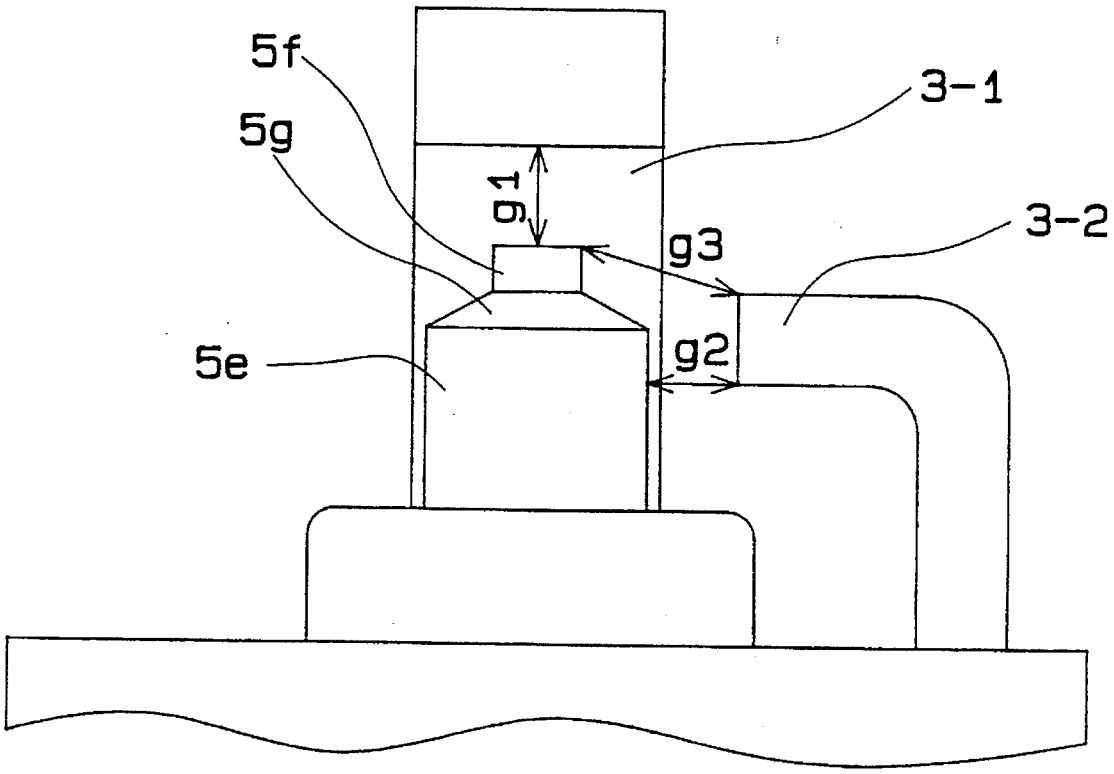
FIG. 5 is a partial enlarged front view of the essentials of a spark plug according to another embodiment of this invention.

According to the foregoing embodiment, ground electrodes 3-2 are structured so as to number two, but it is also possible that only a single ground electrode 3-2 be utilized. FIGS. 4 and 5 indicate the essentials of an embodiment other than the first embodiment. FIG. 4 depicts an article in which one first ground electrode 3-1 and one second ground electrode 3-2 are disposed in symmetrical positions with respect to center electrode 5. FIG. 5 depicts an article in which one first ground electrode 3-1 and one second ground electrode 3-2 are disposed at 90° positions with respect to center electrode 5. Both examples are prototypes prepared with g1=1.0 mm, g2=1.2 mm, g3=1.8 mm, d1=1.0 mm, d2=2.5 mm, and h=0.5 mm. Because it has been possible to fix the spark area, similarly to the above-described embodiment, and also because of being provided with a cylindrical portion 5*f* having a diameter smaller than the diameter of a body 5*e* of center electrode 5, the quenching effect is reduced and ignition performance is enhanced, thus making it possible to cause an idling unstable rate to be reduced. Further since spark area is fixed to first spark gap 12-1 as the main gap, spark discharge is mainly implemented at gap g1.

When electrodes 3-1 and 5 are consumed, gap g1 becomes wider and spark discharge is mainly implemented between second electrode 3-2 and center electrode 5. Therefore life time of the spark plug is extended.

The second embodiment of the preset invention will now be described in connection with the attached drawings. The spark plug according to the present invention includes two spark areas comprising a first spark gap and a second spark gap structured by a center electrode, a bent ground electrode opposing a tip surface of the center electrode, and another bent ground electrode having a tip surface opposing a side surface of the center electrode. Reductions in the discharge voltage have previously been attempted by means of effecting discharge which combines discharge of the first spark gap and discharge of the second spark gap, but the results of diligent study by the inventors have revealed that the discharge voltage also can be reduced in another manner, as will be described below in connection with the second embodiment. By means of disposing a second ground electrode at an optimal position with respect to the center electrode, the discharge voltage can be reduced by means of suppressing the relevant potential surface and heightening the field strength of lateral peripheral surface 5*c* of tip 5*f* of cylindrical configuration of center electrode 5 described for the first embodiment. The second embodiment is described below.

Figure 7:
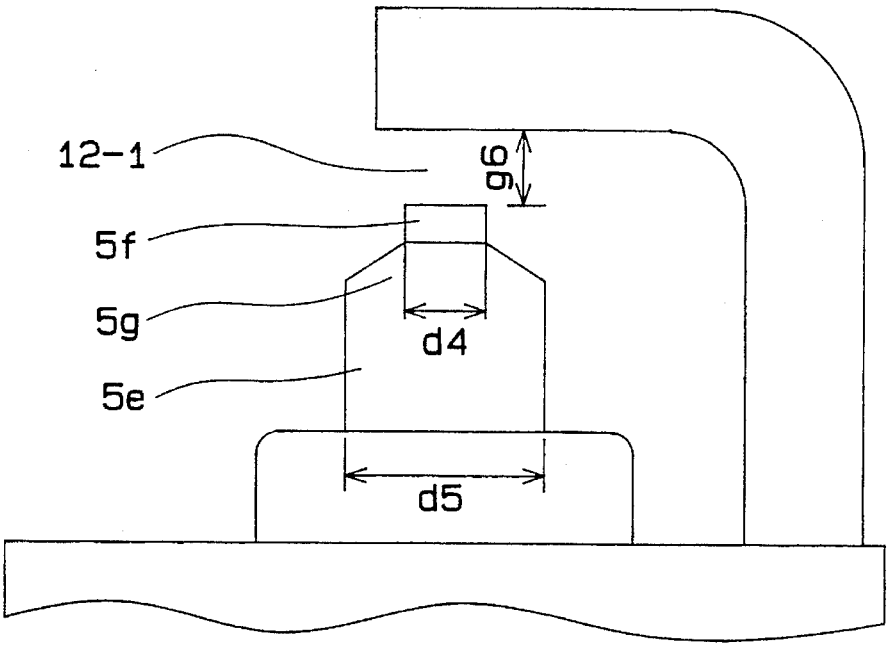
FIG. 7 is a partial enlarged side view of the essentials of a spark plug which is a comparative example.

A prototype of spark plug 1 provided with first, second, and third spark gaps 12-1, 12-2, and 12-3 similar to the first embodiment was made with a thermal value No. 20. Here, the prototype was devised taking the two values of g1=1.0 mm and 1.2 mm, and taking g2=1.0 to 1.8 mm, g3=1.2-g1, d1=1.0 mm, d2=2.5 mm, and h=0 mm. The prototype article so structured was evaluated in an airtight container filled with air by setting the discharge frequency at 30 Hz and applying high voltage to the center electrode to cause spark discharge. High voltage was applied at both positive polarity and negative polarity. Moreover, evaluation was conducted at bench conditions simulating engine conditions, and the pressure within the above-mentioned airtight container was varied up to a pressure of 6 kg/cm$^2$ equivalent to excessive running. Additionally, a spark plug having only a first ground electrode with no second ground electrode was used as a comparative example. FIG. 7 indicates the essentials of the spark plug used as the comparative article, with a spark gap 12-1 size g6=g1, cylindrical tip 5*f* diameter d4=1.0 mm, and body diameter d5=2.5 mm.

Figure 13:
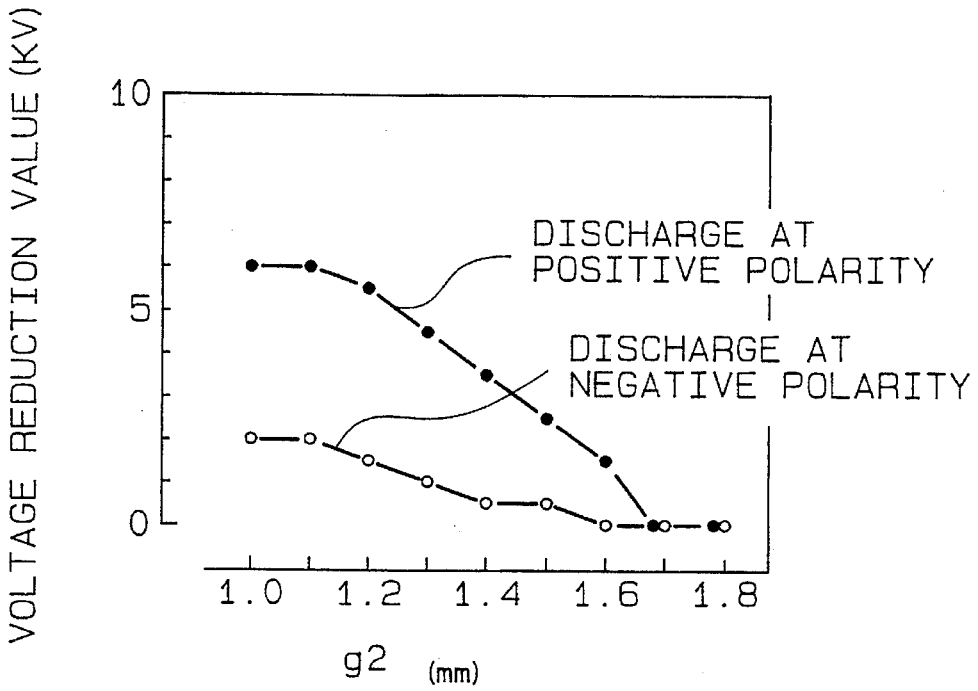
FIG. 13 is a graph indicating a voltage reduction value at a first spark gap of a second embodiment.

FIG. 13 indicates the measurement results for g1=1.0mm. In the figure, the horizontal axis of the graph is the value of g2, and the vertical axis indicates:

Voltage reduction value=(Discharge voltage of comparative example)-(Discharge voltage of embodiment). According to FIG. 13, it can be said that the larger g2 is, the smaller the voltage reduction value becomes, and the discharge voltage can be reduced if g2≦1.6 mm.

Additionally, in the foregoing g2 the reduction effect is greater with discharge at positive polarity than with discharge at negative polarity. This is because whereas discharge at negative polarity results in a strengthening of the spatial electrical field because of positive ion concentration due to ionization at the portion with strongest field strength during voltage application, and accordingly large effects are received, discharge at positive polarity has small spatial field effects and the effects of the electrostatic field are strongly received. According to the present embodiment this phenomenon is applied in order to reduce discharge voltage by means of discharge at positive polarity.

Figure 14:
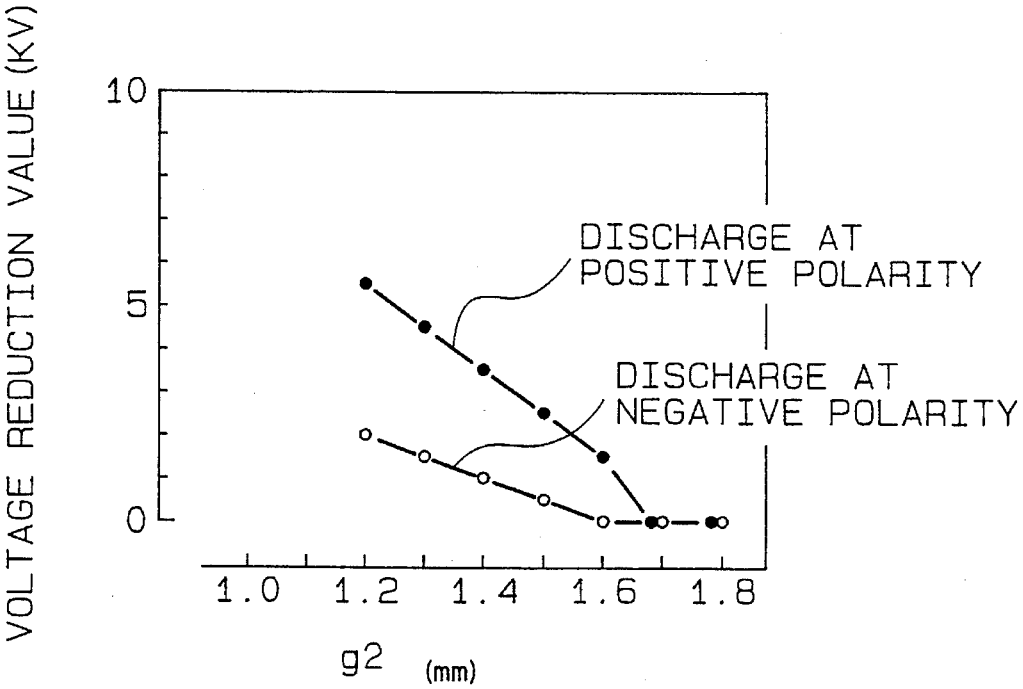
FIG. 14 is a graph indicating a voltage reduction value at a first spark gap of a second embodiment.

FIG. 14 indicates the measurement results for the case of g1=1.2 mm. As is clear from the figure, if g2≦1.6 mm, a voltage reduction effect similar to that obtained when g1=1.0 mm is attained.

It is understood from the above that discharge voltage can be reduced if g2≦1.6 mm, regardless of the size of g1.

Figure 15:
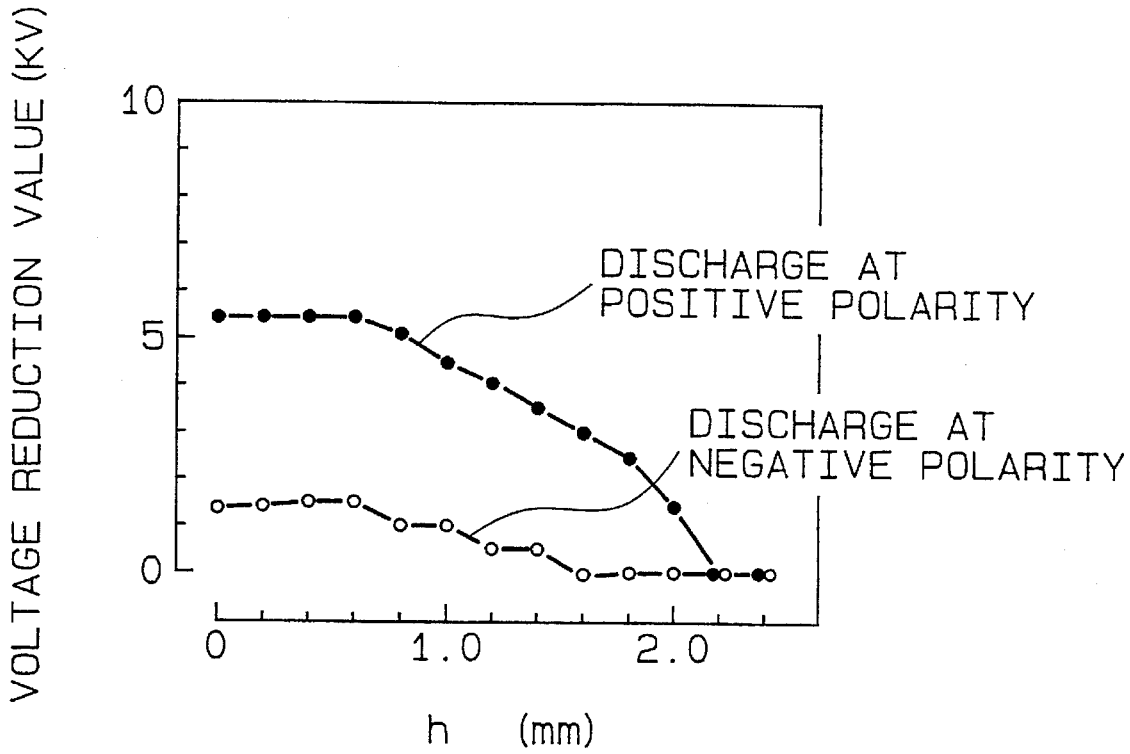
FIG. 15 is a graph indicating a voltage reduction value at a first spark gap of a second embodiment.

The results of an investigation regarding the effect of h will be described next. A similar evaluation was performed on the above-described prototype article with g1=1.0 mm, g2=1.2 mm, g3=1.2-g1, d1=1.0 mm, d2=2.5 mm, and h=0 to 2.0 mm. FIG. 15 indicates the voltage reduction value with respect to g2. The figure shows the voltage reduction value when h=2.0 mm, and it can be said that there is a voltage reduction effect if h≦2 mm. On the other hand, although there is a reduction effect for discharge voltage in the case when h≦0 mm, i.e., in the case when there is a positional relationship such that tip surface 5*a* of electrode 5 exists below bent upper surface of second ground electrodes 3-2, because second ground electrodes 3-2 cover first spark gap 12-1, the flow of the gasoline/air vapor mixture is obstructed and the ignition performance addressed by this invention cannot be improved. According to this, the ignition performance addressed by this invention can be improved only by means of 0 mm≦h≦2 mm.

According to the foregoing embodiment, ground electrodes 3-2 are structured so as to number two, but one is also acceptable as another embodiment. FIG. 4 depicts an article in which one first ground electrode 3-1 and one second ground electrode are disposed in symmetrical positions with respect to a center electrode 5. Effects similar to the foregoing embodiment are obtained by setting 0 mm≦h≦2 mm.

Figure 16:
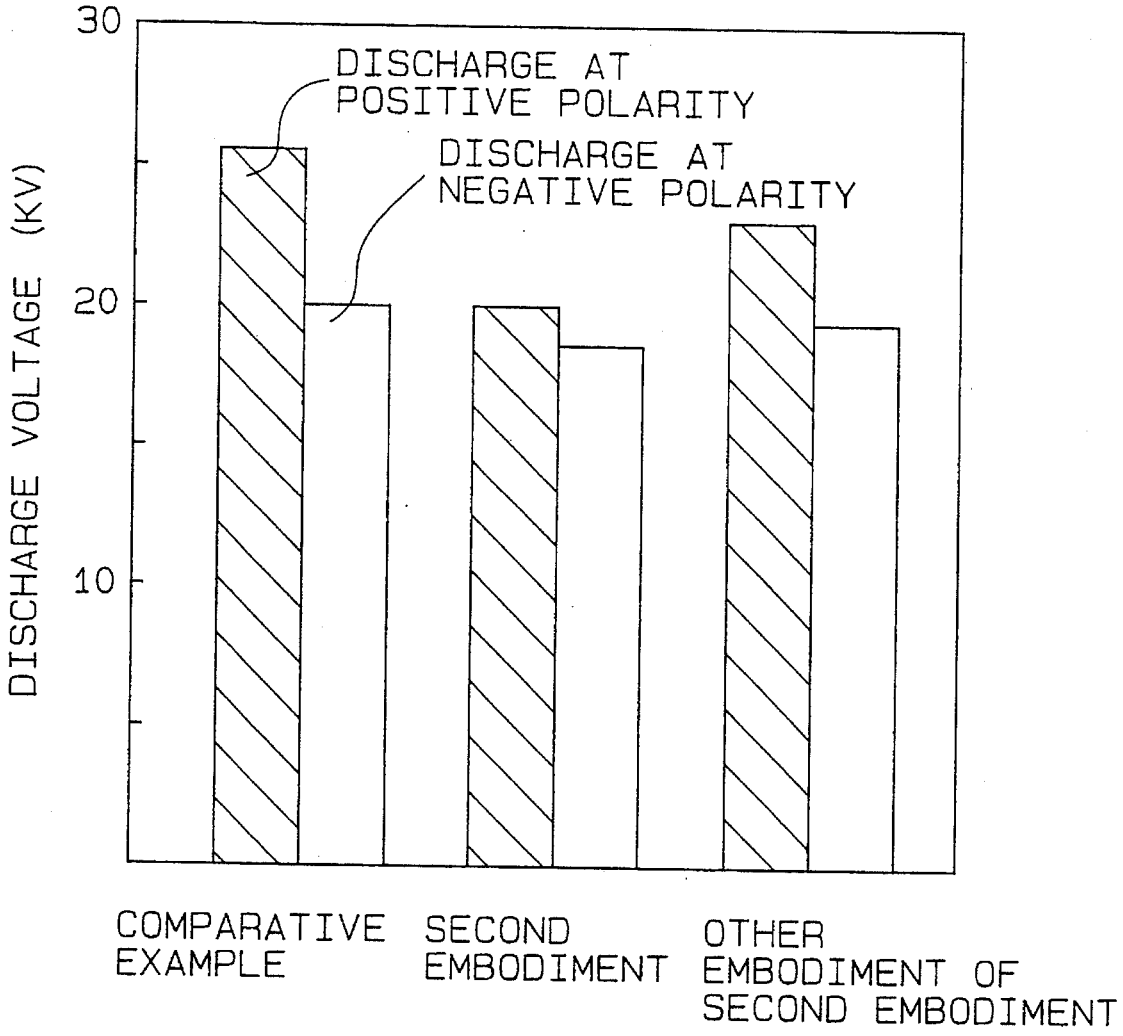
FIG. 16 is a graph comparing and describing discharge voltage of a second embodiment.

The reduction of discharge voltage of an article according to the invention described above was confirmed using a water-cooled, 4-cycle, 1500 cc, 4-cylinder automotive engine. FIG. 16 shows discharge voltage in an actual vehicle, contrasting the foregoing comparative article indicated in FIG. 7 with respect to the second embodiment and a modification of the second embodiment. It was thus possible to confirm reduction of discharge voltage of an article according to this invention with respect to the comparative example, both for positive discharge and for negative discharge.

Additionally, similar to the first embodiment, according to the second embodiment and modifications thereof, because it has been possible to fix the spark area, and also because of being provided with cylindrical portion 5*f* having a diameter smaller than the diameter of body 5*e* of center electrode 5, the quenching effect is reduced and ignition performance is enhanced, and it can even be said that the idling unstable rate can be made to decline.

By means of setting:

g3≧1.2-g1, g2≦g3-(d2-d1)/2, g1≦g2≦1.6, and

0≦h≦2 as in the foregoing description, a spark plug with low discharge voltage and good ignition performance can be provided.

A third embodiment will be described next with reference to FIGS. 17, 18, and 19.

Figure 17:
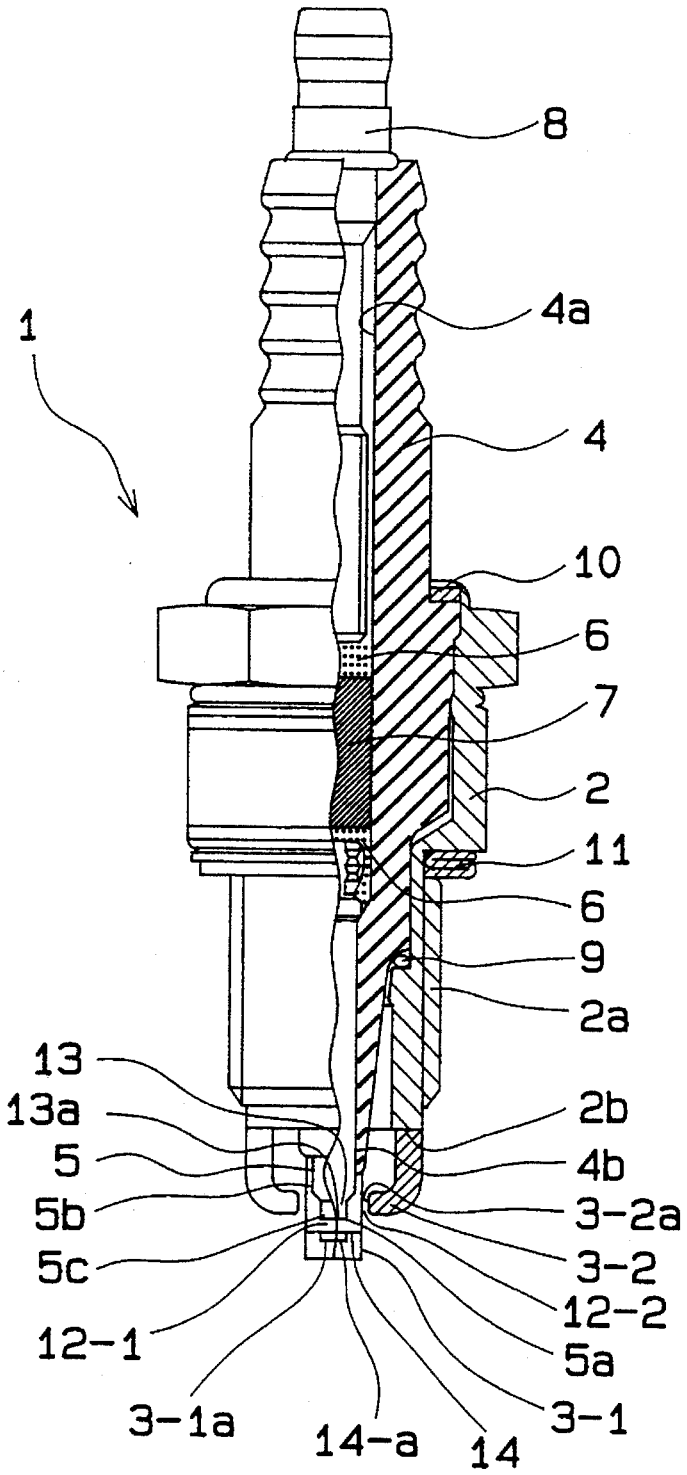
FIG. 17 is a sectional front view of the essentials of a spark plug according to a third embodiment.

FIG. 17 is a partial sectional view of an embodiment according to this invention. Additionally, FIG. 19 is an enlarged front view of an essential portion of this embodiment. Spark plug 1 maintains a center electrode 5 composed of a heat-resistant and corrosion-resistant material such as a nickel alloy having a tip electrode 13*a* composed of precious metal or precious metal alloy at the tip of through-hole 4*a* provided in insulator 4 composed of alumina or the like. Further, the present invention maintains terminal electrode 8 composed of a metal material such as iron at the end of through-hole 4*a* disposed opposite through hole 4*a*. The spark plug further comprises insulator 4 containing conductive glass 6 and resistance body 7, and housing 2 made of metal such as low-carbon steel fixing insulator 4 via gasket 10 and ring 9 made of metal such as copper. Housing 2 is provided with thread portion 2*a* and housing tip surface 2*b* is provided with first ground electrode 3-1 composed of a heat-resistant and corrosion-resistant material such as a nickel alloy. Working tip 3-1*a* of first ground electrode 3-1 is provided with tip electrode 14 composed of precious metal or precious metal alloy, and tip surface of tip electrode 14 opposes tip electrode surface 13*a* of the end tip electrode 13 provided on center electrode 5. Further, working tip 3-1*a* is disposed so as to form first spark gap 12-1. Further, housing tip surface 2*b* is provided with two second ground electrodes positioned 90° with respect to center electrode 5 of first ground electrode 3-1. Accordingly, tip surface 3-2*a* of second ground electrodes 3-2 is disposed so as to oppose lateral peripheral surface 5*b* of center electrode 5, forming second spark gap 12-2. Additionally, high voltage is applied between terminal electrode 8 and housing 2, and is propagated to first or second spark gaps 12-1 or 12-2 by means of a voltage propagation means structured from terminal electrode 8, conductive glass 6, and resistance body 7.

Figure 18:
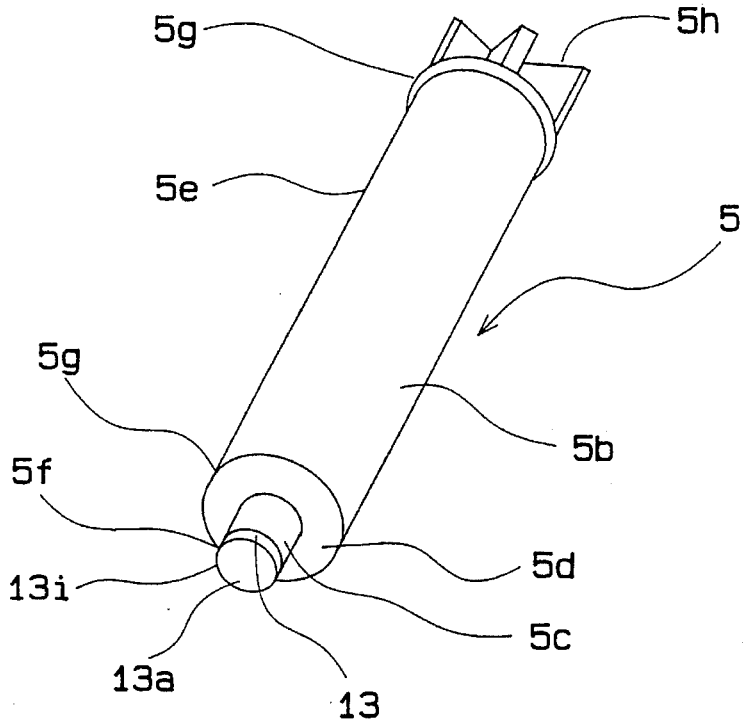
FIG. 18 is a perspective view of a center electrode which is one part of a spark plug according to a third embodiment.

FIG. 18 is a perspective view of center electrode 5, which is a forged part produced by means of cold forging and cut to provide tip 5*f* of cylindrical configuration and truncated-cone portion 5*d* on a tip portion of body 5*e*. Accordingly, the above-mentioned tip electrode 13 composed of precious metal or a precious metal alloy is attached by means of welding to tip surface 5*a* (not illustrated) of tip 5*f*. Tip electrode 13 is maintained in position provided in through-hole 4*a* in insulator 4 and not shown in FIG. 1 with a collar portion 5*g* attached to lateral peripheral surface 5*b* of the above-mentioned body 5*e* during cold forging. Collar portion 5*g* is held at through-hole 4*a* and fixed by conductive glass 6. Additionally, 5*c* is a lateral peripheral surface.

Figure 19:
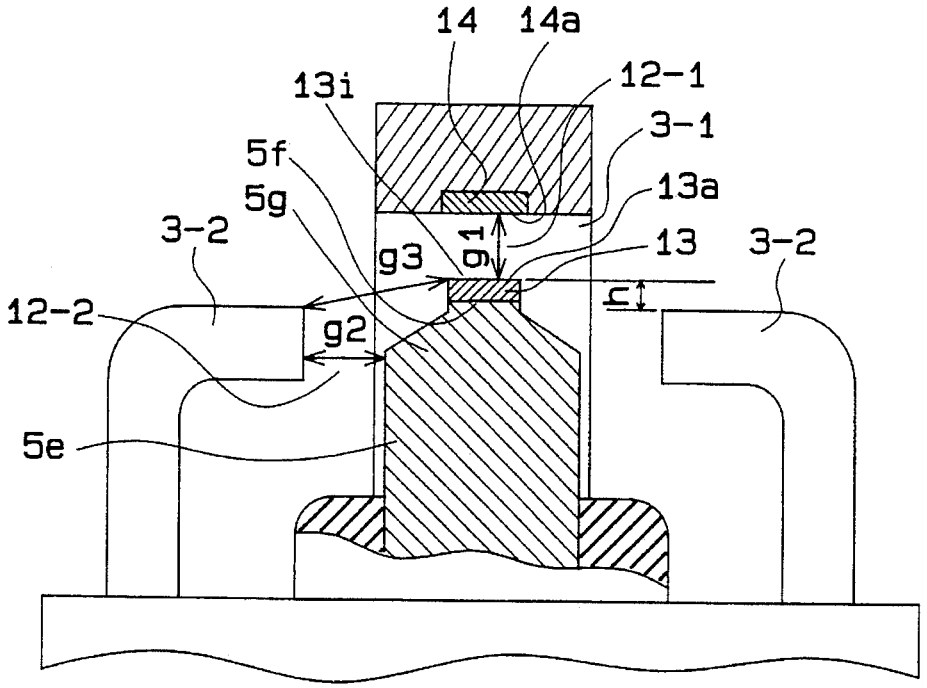
FIG. 19 is a partial enlarged sectional front view of the essentials of a spark plug according to a third embodiment.

FIG. 19 is a partial sectional view of an enlarged front view of the essential portion of a modification of the second embodiment according to this invention. According to the figure, g1 represents the size of first spark gap 12-1, g2 represents the size of second spark gap 12-2, g3 represents the shortest distance between an outer end portion 3-2*b* of tip surface 3-2*a* of second ground electrode 3-2 and a peripheral portion 13*i* of the tip surface 13*a* of tip electrode 13 attached to center electrode 5. Further, h is the coaxial distance with center electrode 5 between upper end portion of tip surface 3-2*a* and tip surface 13*a* of tip electrode 13 attached to center electrode 5, d1 represents the diameter of tip 5*f*, and d2 represents the diameter of body 5*e*. Moreover, in the case wherein the surface of tip electrode 13 is smaller than tip surface 5*a* of tip 5*f*, g3 is defined as the distance indicated for the first embodiment. An evaluation similar to the first embodiment and the second embodiment was conducted for the invention as described above. Furthermore, for the invention as described, by means of taking the foregoing dimensions as:

$g3 \geqq 1.2\text{-}g1$, $g2 \leqq g3\text{-}(d2\text{-}d1)/2$, $g1 \leqq g2 \leqq 1.6$, and $0 \leqq h \leqq 2$ similar to the first and second embodiments, the spark area can be fixed, the quenching effect is reduced and ignition performance is enhanced by means of providing tip electrode 13 having a diameter smaller than the diameter of body 5*e* of center electrode 5. The idling unstable rate can be made to decline. By means of this, it is possible to provide a spark plug having low discharge voltage and good ignition performance. Moreover, because first spark gap 12-1 is established as the main gap and tip electrodes 13 and 14 composed of precious metal or precious metal alloy are attached to the ignition portion, resistance to electrode wear is superior to the foregoing first embodiment.

What is claimed is:

1. A spark plug comprising:

an insulator having a through-hole, a center electrode having a tip portion, a tip surface at the end of said tip portion and a center electrode body maintained in said through-hole, a voltage propagation means provided in said through-hole, a housing maintaining said insulator, at least first and second bent ground electrodes attached to a tip surface of said housing, said first and second ground electrode being electrically connected to said housing, and wherein said first ground electrode opposes said tip surface of said tip portion to form a first gap between said tip surface and said first ground electrode and said second ground electrode opposes a lateral peripheral surface of said center electrode to form a second gap between said center electrode body and said second ground electrode, wherein the spark plug satisfies:

$g3 \geqq 1.2 \times g1$;

$g1 \leqq g2 \leqq 1.6$; and $0 \leqq h \leqq 2$ wherein a size of said first spark gap is g1, a size of said second spark gap is g2, g3 is the shortest distance between said tip surface of said tip portion and said second ground electrode, a height from an edge of a tip surface of said second ground electrode to said tip surface of said tip portion is h, and the units of g1, q2, g3 and h are millimeter.

2. A spark plug according to claim 1, wherein at least one of said first ground electrode, said second ground electrode and said center electrode has a chip composed of precious metal or precious metal alloy.

3. A spark plug comprising:

an insulator having a through-hole, a center electrode maintained in said through-hole, a voltage propagation means provided in said through-hole, a housing maintaining said insulator, two bent ground electrodes attached to a tip surface of said housing, and spark gaps formed by means of said center electrode and said bent ground electrodes, said first and second ground electrode being electrically connected to said housing, wherein one of said bent ground electrode opposes a tip surface of said center electrode to form a first gap and the other of said bent ground electrode opposes a lateral peripheral surface of said center electrode to form a second gap, wherein a tip surface of at least one of said ground electrode and said center electrode being provided with an electrode composed of precious metal or precious metal alloy, and further satisfying:

$g3 \geqq 1.2 \times g1$, $g1 \leqq g2 \leqq 1.6$; and $0 \leqq h \leqq 2$ wherein said first spark gap size is g1, said second spark gap size is g2, g3 is a shortest distance between said center electrode tip surface peripheral portion and said second ground electrode tip surface outer end portion, said center electrode protrusion length from an edge of said second ground electrode is h, and the units of g1, g2, g3 and h are millimeter.

4. A spark plug comprising:

a center electrode having a tip portion and a body;

first and second ground electrodes, said first and second ground electrodes being electrically connected to said housing; and first and second spark gaps formed by means of said center electrode and said ground electrodes;

wherein said spark plug satisfies the following conditions:

$g3 \geqq 1.2 \times g1$, $g1 \leqq g2 \leqq 1.6$; and $0 \leqq h \leqq 2$ wherein said first spark plug size is g1, said second spark gap size is g2, a shortest distance between an end of said tip portion of said center electrode and said second ground electrode's tip surface outer end portion is g3, said center electrode tip protrudes coaxially from said center electrode body beyond a tip surface outer end portion of said second ground electrode by a length h, and the units of g1, g2, g3 and h are millimeter.

* * * * *